US008942588B2

(12) United States Patent
Matsumoto

(10) Patent No.: US 8,942,588 B2
(45) Date of Patent: Jan. 27, 2015

(54) IMAGE FORMING APPARATUS AND CONTROL METHOD FOR IMAGE FORMING APPARATUS FOR SWITCHING A PRINTING METHOD BASED ON STATE OF DRAWING OBJECT

(71) Applicant: Canon Kabushiki Kaisha, Tokyo (JP)

(72) Inventor: Takuya Matsumoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 13/687,777

(22) Filed: Nov. 28, 2012

(65) Prior Publication Data

US 2013/0136478 A1 May 30, 2013

(30) Foreign Application Priority Data

Nov. 30, 2011 (JP) ..... 2011-261838

(51) Int. Cl.
*G03G 15/00* (2006.01)
*G03G 21/00* (2006.01)
*G03G 15/20* (2006.01)

(52) U.S. Cl.
CPC ..... *G03G 21/0005* (2013.01); *G03G 15/2014* (2013.01); *G03G 15/5029* (2013.01); *G03G 15/6558* (2013.01); *G03G 21/00* (2013.01); *G03G 2215/00438* (2013.01)
USPC ..... 399/67

(58) Field of Classification Search
USPC ..... 399/67
See application file for complete search history.

(56) References Cited

FOREIGN PATENT DOCUMENTS

JP 2007-286108 A1 11/2007

*Primary Examiner* — Walter L Lindsay, Jr.
*Assistant Examiner* — Ruth Labombard
(74) *Attorney, Agent, or Firm* — Canon USA, Inc., IP Division

(57) ABSTRACT

An image forming apparatus including a feeding unit configured to feed a paper sheet, a fixing unit configured to fix a toner image onto the paper sheet fed by the feeding unit based on an image to be printed, and a determination unit configured to determine, for each page, whether to execute, by the fixing unit, fingerprint trace removal processing for removing a fingerprint trace adhering to the paper sheet fed by the feeding unit, wherein if it is determined to execute the fingerprint trace removal processing, the fixing unit is configured to perform the fixing of the toner image after performing the fingerprint trace removal processing.

5 Claims, 18 Drawing Sheets

IMAGE FORMING APPARATUS AND CONTROL METHOD FOR IMAGE FORMING APPARATUS FOR SWITCHING A PRINTING METHOD BASED ON STATE OF DRAWING OBJECT

BACKGROUND OF THE INVENTION

1. Field of the Invention

The present invention relates to an image forming apparatus, and a control method for the image forming apparatus, for switching a printing method based on a state of a drawing object.

2. Description of the Related Art

As a conventional technology, an image forming apparatus employing an electrophotographic method that outputs an image by transferring a toner image formed on a photosensitive drum onto a recording medium, and pressure-fusing the transferred image with a fixing device to fix the image on the recording medium is known. In such an image forming apparatus, oil and moisture (hereinafter referred to as a "fingerprint trace") from a person that has adhered to the printing paper can cause fixing defects to occur (because the fingerprint trace hinders the transfer and fixing of the toner image by changing the resistivity of the printing paper). The extent of the fixing defect caused by fingerprint traces changes based on the type and the color of the paper used for printing.

Japanese Patent Application Laid-Open No. 2007-286108 discusses an image forming apparatus that, to improve upon the above-described fixing defect problem, includes a function in which an attached fingerprint trace is evaporated by the heat from a fixing device when a paper sheet is passed through the fixing device before printing, after which the paper sheet is again returned to the conveyance path and printing is executed (hereinafter referred to as a "fingerprint trace removal function").

In the image forming apparatus discussed in Japanese Patent Application Laid-Open No. 2007-286108, the fingerprint trace removal function can be switched between ON (hereinafter referred to as "fingerprint trace removal mode") and OFF (hereinafter referred to as "normal mode") based on user selection. In fingerprint trace removal mode, all of the paper sheets used in printing are passed once through a pair of fixing rollers, and then returned to the conveyance path. Consequently, fingerprint trace removal mode has a slower printing speed than normal mode.

However, in a conventional fingerprint trace removal mode, printing is executed regardless of the type of paper or the printing content of the respective paper sheets, even for paper sheets for which there is no need to execute printing based on fingerprint trace removal mode (e.g., printing when a fingerprint trace adheres only to the edges of the paper sheet and toner will only be fixed in the center of the paper sheet, or printing using a paper sheet on which fixing defects due to fingerprint traces do not easily stand out etc.). Consequently, in the fingerprint trace removal mode discussed in Japanese Patent Application Laid-Open No. 2007-286108, unnecessary delays in the printing speed occur by passing even paper sheets on which fingerprint traces do not easily stand out through a fixing device before printing.

SUMMARY OF THE INVENTION

The present invention is directed to an image forming apparatus capable of efficiently executing fingerprint trace removal.

According to an aspect of the present invention, an image forming apparatus includes a feeding unit configured to feed a paper sheet, a fixing unit configured to fix a toner image onto the paper sheet fed by the feeding unit based on an image to be printed, and a determination unit configured to determine, for each page, whether to execute, by the fixing unit, fingerprint trace removal processing for removing a fingerprint trace adhering to the paper sheet fed by the feeding unit, wherein if it is determined to execute the fingerprint trace removal processing, the fixing unit is configured to perform the fixing of the toner image after performing the fingerprint trace removal processing.

According to another aspect of the present invention, an image forming apparatus includes a feeding unit configured to feed a paper sheet, a fixing unit configured to fix a toner image onto the paper sheet fed by the feeding unit based on an image to be printed, and a determination unit configured to determine whether to execute, by the fixing unit, fingerprint trace removal processing for removing a fingerprint trace adhering to the paper sheet fed by the feeding unit only if the paper sheet is a specific type, wherein if it is determined to execute the fingerprint trace removal processing, the fixing unit is configured to perform the fixing of the toner image after performing the fingerprint trace removal processing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
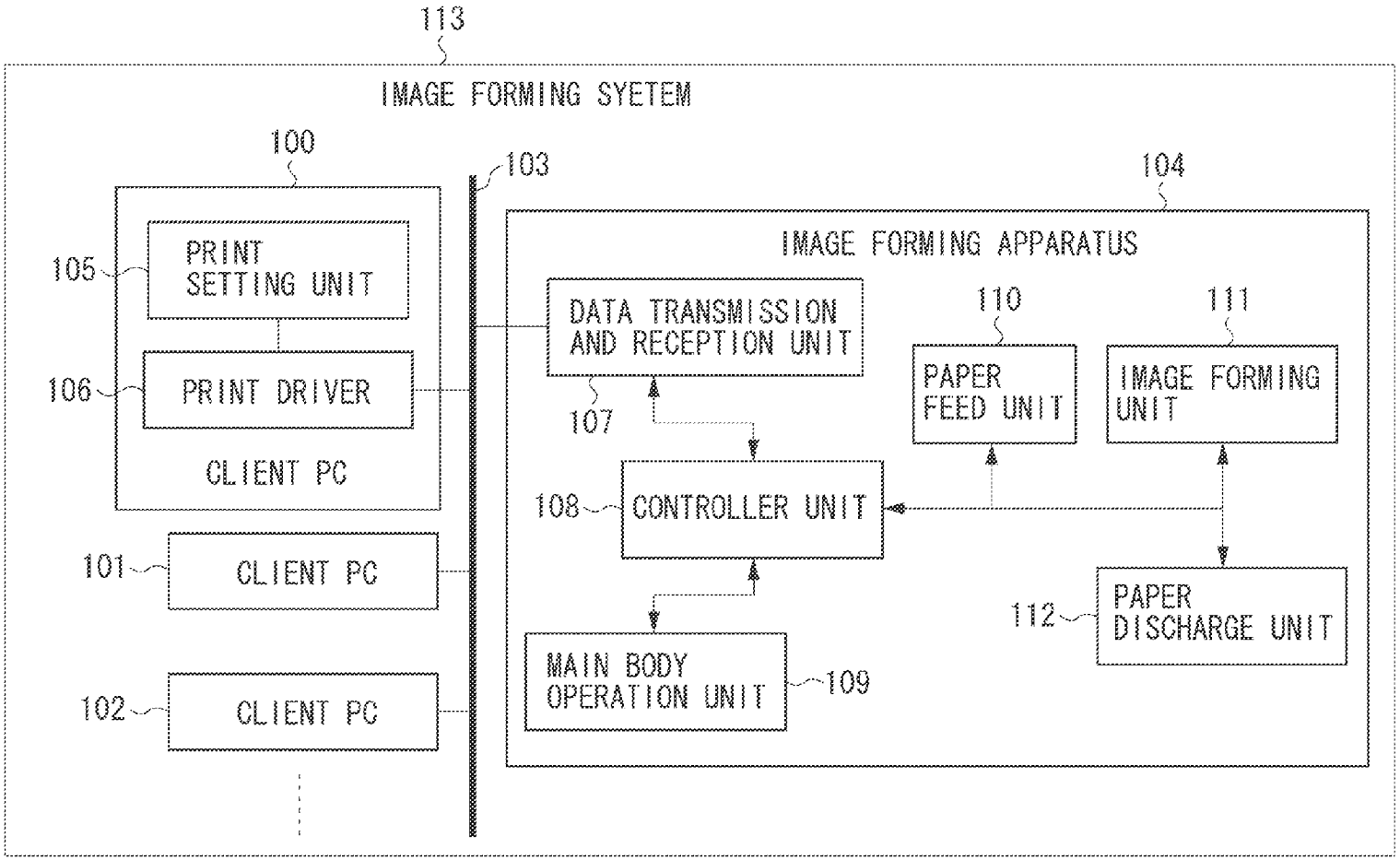
FIG. 1A is a configuration diagram of an image forming system.

FIG. 1A is a configuration diagram of an image forming system 113 according to an exemplary embodiment of the present invention. The image forming system 113 is configured from one or a plurality of client PCs 100, 101, and 102 connected via a network 103, and an image forming apparatus 104.

The client PCs 100, 101, and 102 are configured from a print setting unit 105, which is capable of performing various print settings, and a print driver 106.

Figure 2:
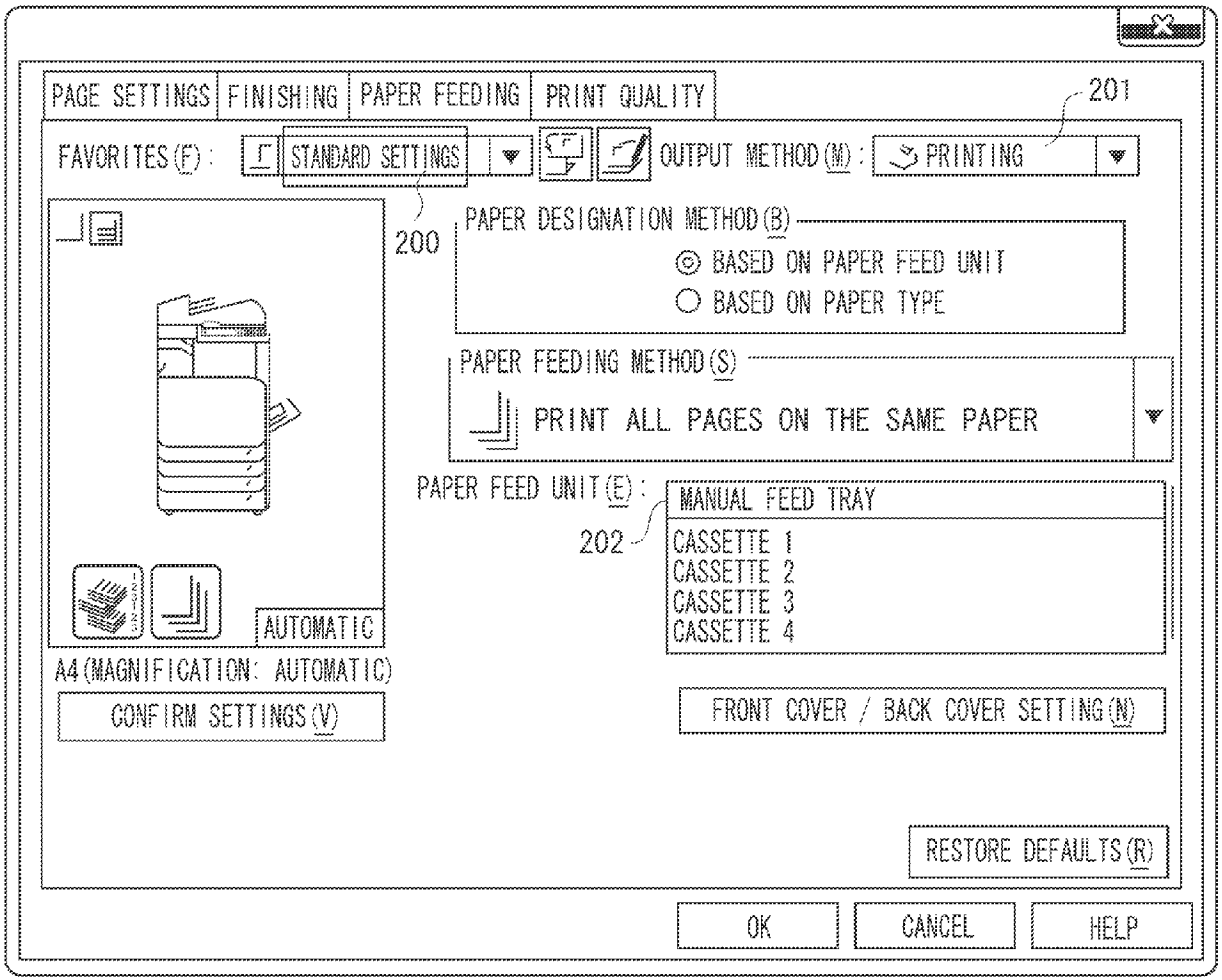
FIG. 2 illustrates an example of a print setting screen in a printing setting unit according to an exemplary embodiment of the present invention.

FIG. 2 illustrates an example of a print setting screen in the print setting unit 105.

A print screen setting 200 can switch between a one-sided/two-sided print setting. An output method 201 can switch an output destination (printer, user box, secure printing etc.) for a print product. A paper feed unit setting 202 is a setting for switching the paper feeding source of paper sheets in the image forming apparatus 104. The print setting unit 105 can also acquire an apparatus state from the image forming apparatus 104, and display that state.

The above-described print settings set by the user are sent as a print job to the image forming apparatus 104 via the network 103 by the print driver 106. In the following description, an example will be described in which a print job is sent from the client PC 100.

The present exemplary embodiment will be described using a printing apparatus as an example. However, operation based on the present exemplary embodiment can still be performed even if the image forming apparatus 104 has functions other than as a printing apparatus, such as of a copying machine or a multifunction peripheral having scan, send, and print functions, for example, as long as the image forming apparatus 104 has a printing function and an operation function.

The image forming apparatus 104 is configured from a data transmission and reception unit 107, a controller unit 108, a main body operation unit 109, a paper feed unit 110, an image forming unit 111, and a paper discharge unit 112.

Each of these parts will now be described. The data transmission and reception unit 107 transmits the print jobs input from the client PC 100 via the virtual object management unit 103 to the controller unit 108 in the input order. The print jobs are written in a printer language called a page description language (PDL). Further, the data transmission and reception unit 107 receives an apparatus information acquisition request from the client PC 100, and transmits that request to the controller unit 108. In addition, the data transmission and reception unit 107 transmits to the client PC 100 data returned from the controller unit 108 in response to the request.

The controller unit 108 performs control of the print jobs and the apparatus devices (the data transmission and reception unit 107, the main body operation unit 109, the paper feed unit 110, the image forming unit 111, and the paper discharge unit 112).

Figure 1B:
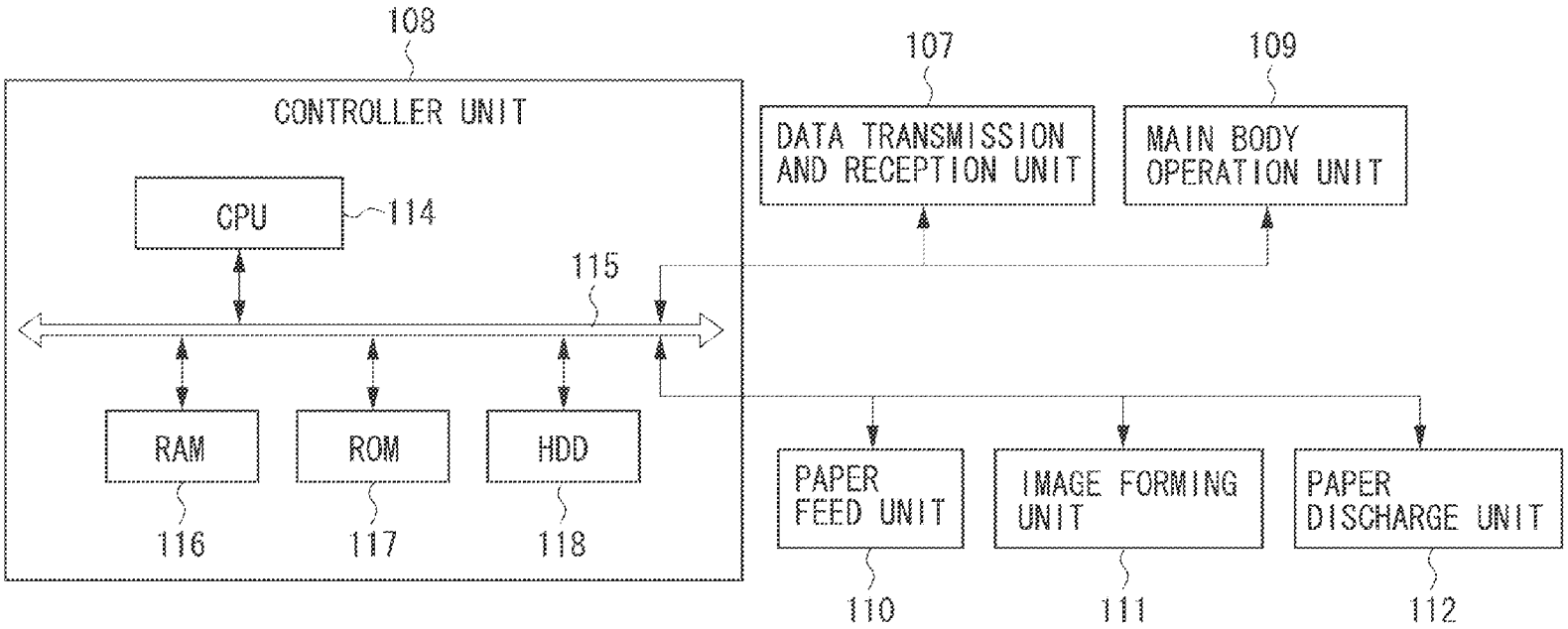
FIG. 1B is a configuration diagram of a control unit.

FIG. 1B is a configuration diagram illustrating an example of the controller unit 108, which is configured from a central processing unit (CPU) 114, a system bus 115, a random access memory (RAM) 116, a read-only memory (ROM) 117, and a hard disk drive (HDD) 118. The CPU 114 starts the controller unit 108 by reading a program (a boot program, an operating system, or an application program) stored in the ROM 117 or the HDD 118 into the RAM 116. The HDD 118 is also used as a temporary storage area that is necessary to execute the print jobs. An application program 119 is started by the CPU 114, and performs tasks such as print job execution and apparatus device control.

Figure 1C:
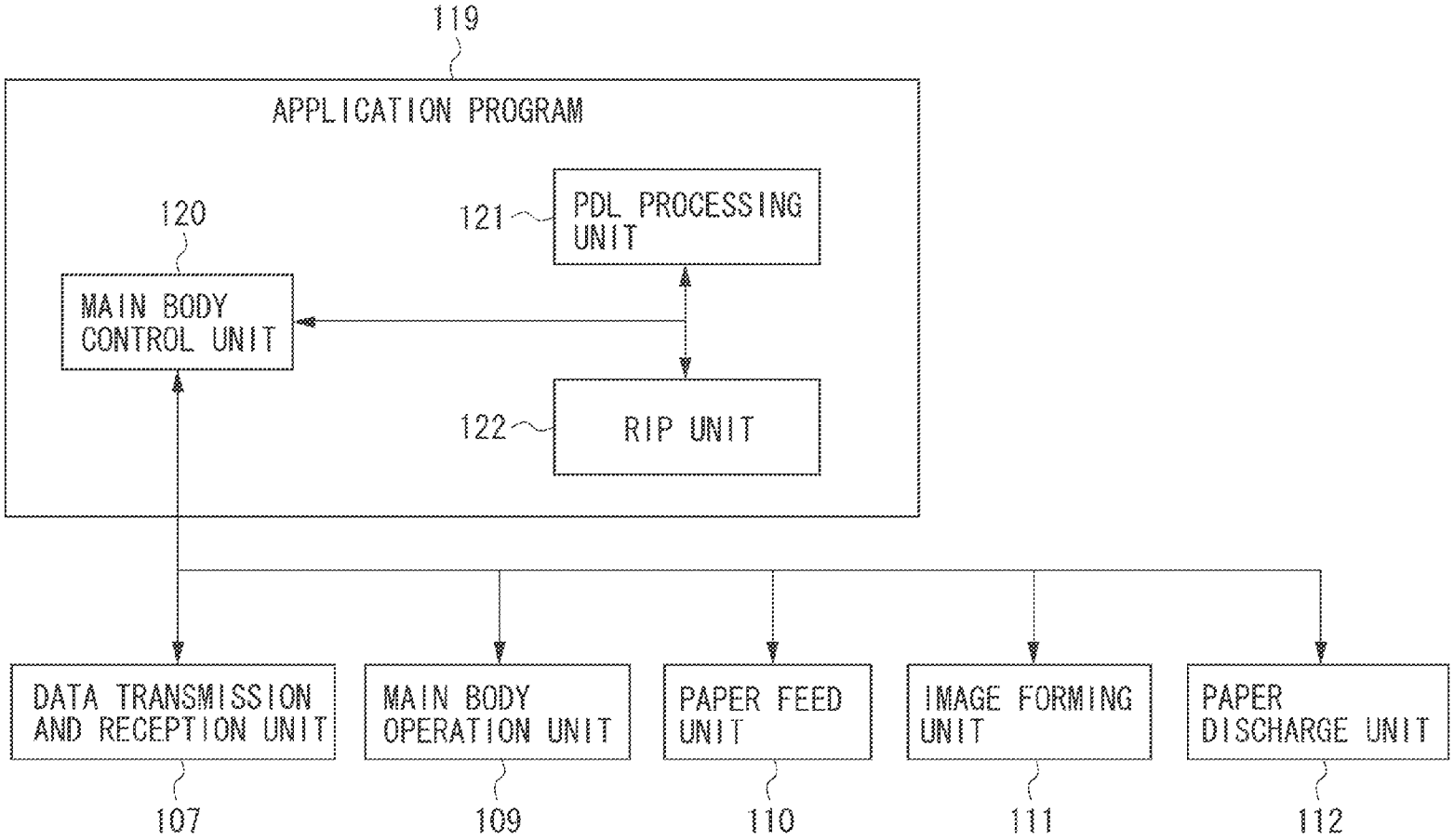
FIG. 1C is a block diagram of an application program.
Figure 1D:
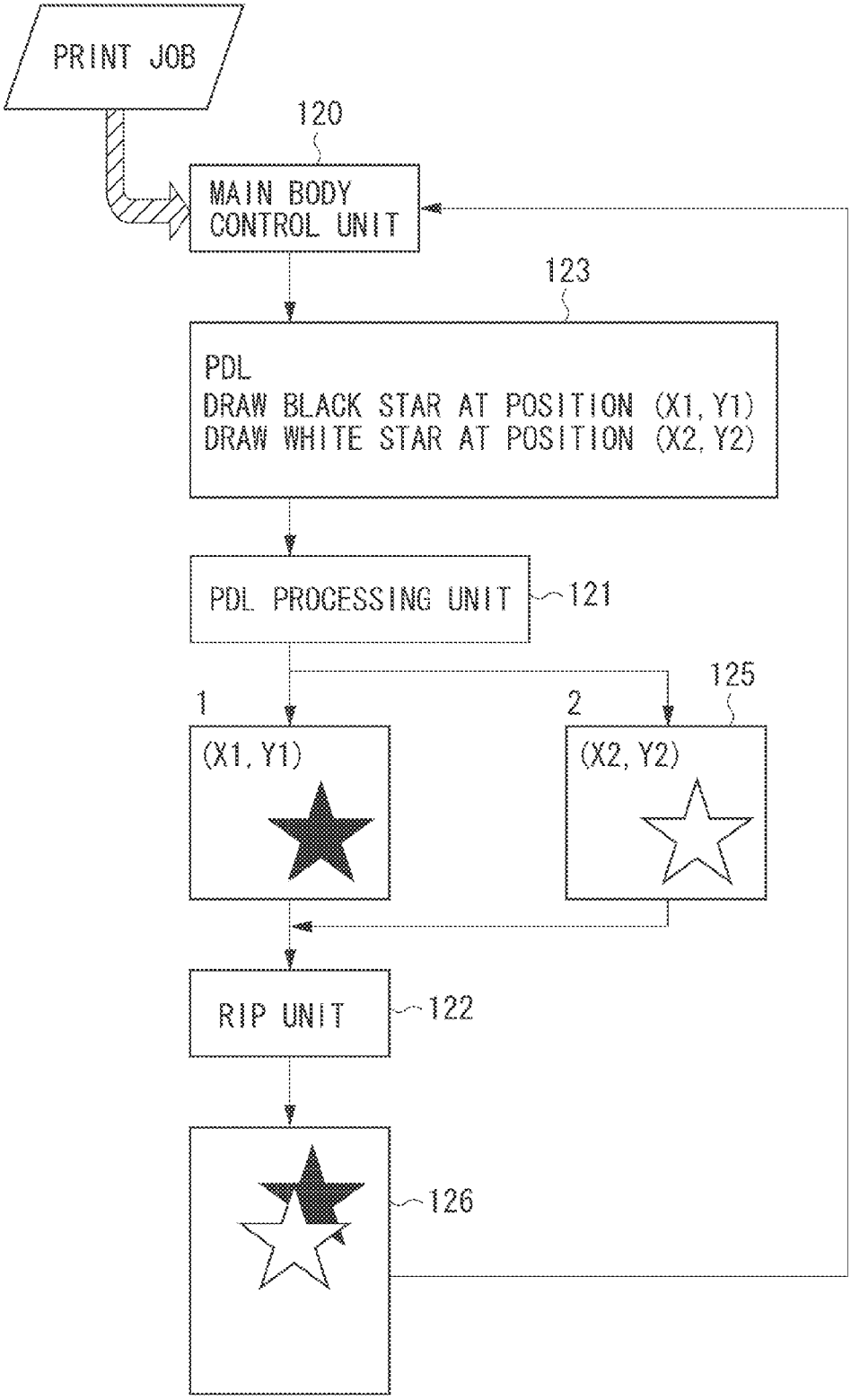
FIG. 1D illustrates an example of application program processing.

FIG. 1C is a block diagram illustrating an example of the application program 119. The application program 119 is configured from a main body control unit 120, a PDL processing unit 121, and a RIP (raster image processor) unit 122. FIG. 1D illustrates an example of the processing of this application program. The main body control unit 120 mainly performs control of the print job print processing and the apparatus devices. The main body control unit 120 transmits a PDL 123 included in a print job to the PDL processing unit 121. The PDL processing unit 121 analyzes the PDL 123 received from the main body control unit 120. Next, the PDL processing unit 121 generates drawing objects 124 and 125 based on the analysis result. The drawing objects 124 and 125 include information such as a drawing position, a drawing shape, and a drawing color based on the analysis result. Further, the PDL processing unit 121 transmits the drawing objects 124 and 125 to the RIP unit 122 in the order of analysis (124 then 125). The RIP unit 122 generates image data based on the drawing objects 124 and 125 received from the PDL processing unit 121. If there is an overlapping portion between the drawing objects, the RIP unit 122 basically performs processing based on a last-in-first-out basis. Consequently, for drawings with an overlapping portion like that illustrated by image data 126, the drawing object 125 drawing is applied (this is not necessarily the case when using an over-printing technique). The RIP unit 122 transmits the image data 126 to the main body control unit 120. The main body control unit 120 stores this image data until the processing that is performed by the image forming unit 111.

Figure 3:
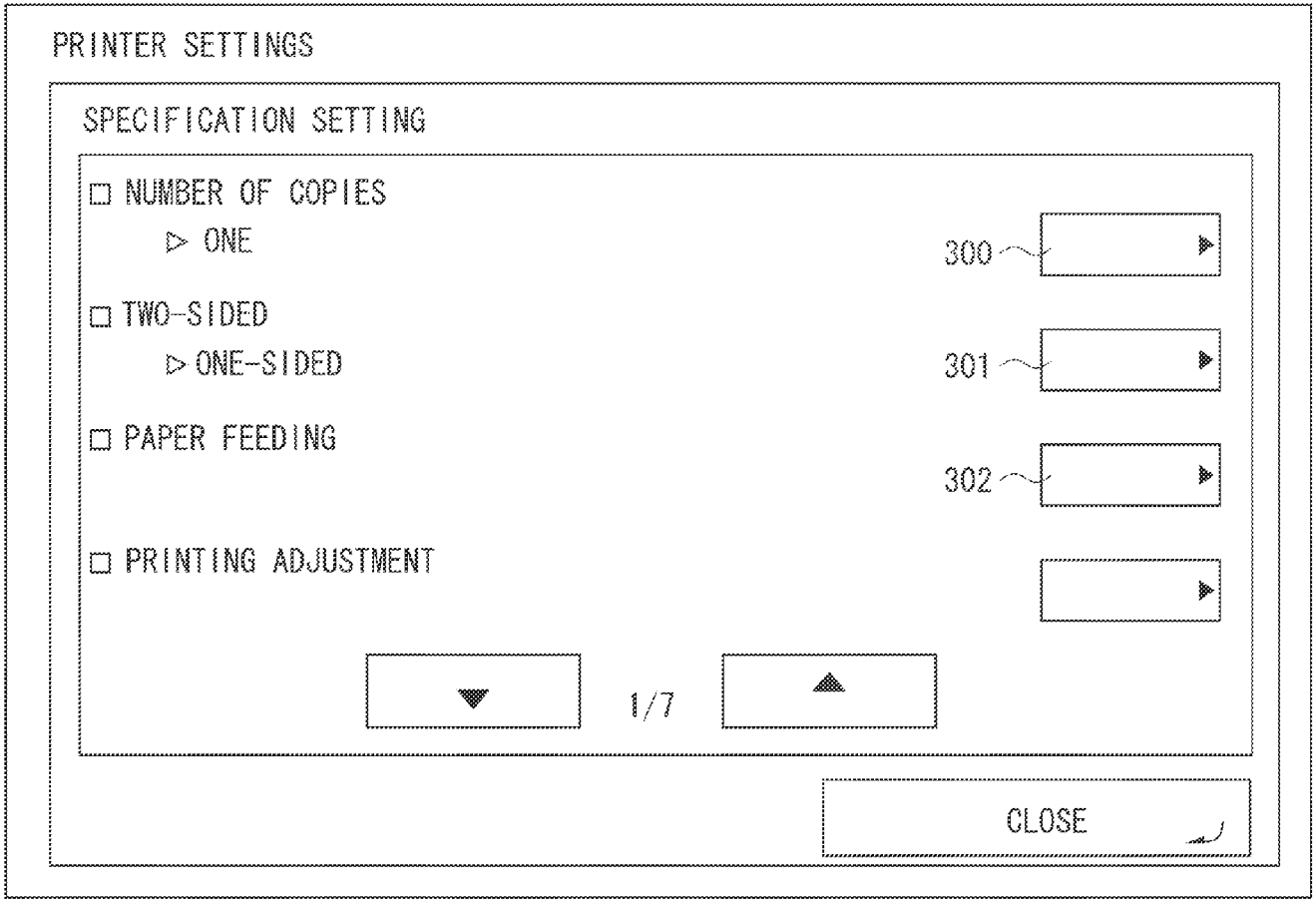
FIG. 3 illustrates an example of an apparatus print setting screen in a main body operation unit.

It is possible for the user to reference and change an apparatus print setting with the main body operation unit 109. The main body operation unit 109 transmits an apparatus print setting changed by the user to the main body control unit 120. The main body control unit 120 processes the print job along with this apparatus print setting. FIG. 3 illustrates an example of a setting screen for this apparatus print setting in the main body operation unit 109. This setting screen displays various apparatus print settings, such as a number of copies setting 300, a two-sided printing setting 301, and a paper feed setting 302. These settings are changed by a user operation. Further, a print job state, for example, can be acquired from the main body control unit 120 and displayed by the main body operation unit 109.

Figure 4:
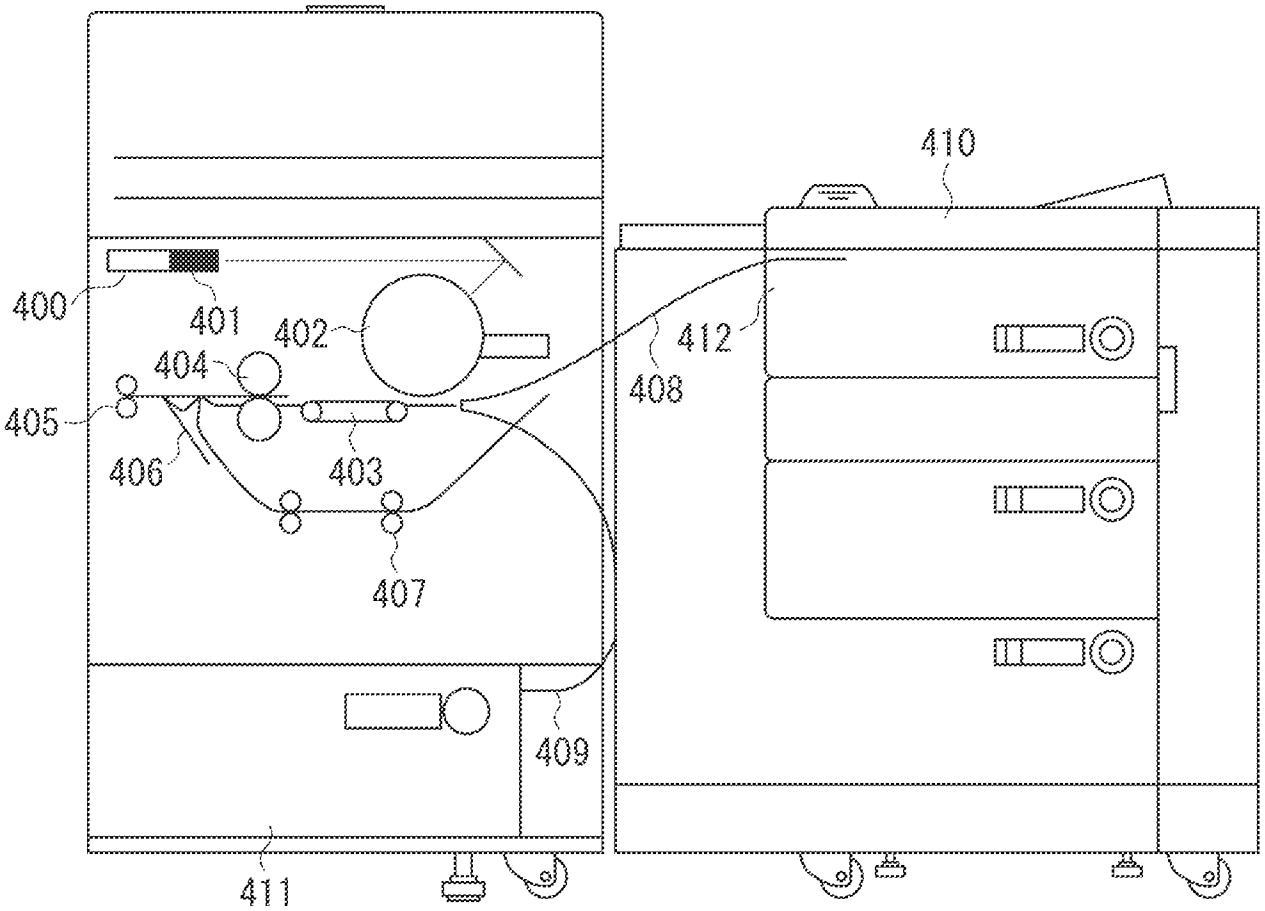
FIG. 4 is a cross-sectional side view of an image forming apparatus.

FIG. 4 is a cross-sectional side view of the paper feed unit 110 and the image forming unit 111. The paper feed unit 110 is configured from a cassette paper feed stage 411, a manual feed tray 410, and a print-on-demand (POD) deck 412. The paper feed unit 110 can be set with various types of paper sheet by the user.

The image forming unit 111 forms an image on a paper sheet based on the image data stored in the main body control unit 120. The image forming unit 111 has a laser driver 400. The laser driver 400 drives a laser emitting unit 401 based on this image data. Consequently, the laser emitting unit 401 emits laser light based on the image data. This laser light is irradiated onto a photosensitive drum 402. The photosensitive drum 402 forms an electrostatic latent image based on the irradiated laser light. This electrostatic latent image is visualized as a toner image by toner supplied from a development device. The paper sheet used in printing is fed via a conveyance path between the photosensitive drum 402 and a transfer unit 403 in synchronization with the laser light irradiation timing. The toner image on the photosensitive drum 402 is transferred onto this fed paper sheet by the transfer unit 403.

In the image forming apparatus 104 according to the present exemplary embodiment, the orientation of the front and back of the conveyed paper sheet is different based on the configuration of the paper feed unit 110. The paper feeding from the manual feed tray 410 and the POD deck 412 uses a conveyance path 408 on the left side of the photosensitive drum. The paper feeding from the cassette paper feed stage 411 uses a conveyance path 409 on the lower side of the photosensitive drum.

The paper sheet on which the toner image has been transferred is fed to a pair of fixing rollers (a heating roller and a pressing roller) 404 via a conveyance belt. The pair of fixing rollers 404 fixes the toner image on the paper by heating and pressing the paper sheet. After passing through the pair of fixing rollers 404, the paper sheet is discharged to the paper discharge unit 112 by a paper discharge roller 405.

After an image has been formed on the paper sheet designated during the print job based on the print job designated as two-sided printing, the image forming unit 111 reverses the rotation direction of the paper discharge roller 405, and guides the paper sheet again to a re-fed paper conveyance path 407 with a flapper 406. The paper sheet guided to a re-fed paper conveyance path 407 is, again, fed between the photosensitive drum 402 and the transfer unit 403 in synchronization with the above irradiation timing, so that a toner image is transferred onto the opposite surface to that on which an image was formed just before. Then, the toner on the paper sheet is again fixed by the pair of fixing rollers 404. Consequently, an image is formed on both sides of the paper sheet. Lastly, the paper sheet is discharged to the paper discharge unit 112 by the paper discharge roller 405.

Fingerprint traces adhering to the paper sheet are removed by evaporation by the heat when the paper sheet is passed once through the pair of fixing rollers 404. Consequently, a paper sheet on which an image will be formed based on a print job designating fingerprint trace removal (hereinafter, referred to as "fingerprint trace removal mode") is subjected to processing similar to a paper sheet for a print job designated as two-sided printing. When this paper sheet passes between the photosensitive drum 402 and the image forming unit 403, nothing is transferred. Subsequently, although the paper sheet is heated by the pair of fixing rollers 404, since toner is not transferred, the face on which image data would normally be printed is white. Therefore, the paper sheet passes through the re-fed paper conveyance path 407 in the same way as a paper sheet on which an image will be formed based on a print job designated as two-sided printing, and is again fed between the photosensitive drum 402 and the image forming unit 403. During this operation, a toner image based on the image data is transferred onto the paper sheet surface opposite to that on which printing would normally be performed, and this toner image is fixed on the paper sheet by the pair of fixing rollers 404. Since a print job in fingerprint trace removal mode uses a paper feed conveyance path that is similar to a print job designated as two-sided printing, at the print setting unit illustrated in FIG. 2, a setting from a (not illustrated) finishing tab can only be used during one-sided printing (printing in which the re-fed paper conveyance path 407 is not used).

The paper discharge unit 112 is configured from various paper discharge stages that discharge the discharge paper sheets on which a toner image was fixed by the image forming unit 111 based on the type and mode of the output paper sheets.

A first exemplary embodiment will now be described with reference to FIGS. 5A to 8D. The first exemplary embodiment is an example of determining whether printing in fingerprint trace removal mode is necessary, based on the position of an image to be formed on the paper sheet.

If the print job setting input from the client PC 100 or the apparatus printing setting set in the main body control unit 120 from the main body operation unit 109 indicates one-sided printing, the main body control unit 120 performs a fingerprint trace removal/normal mode (fingerprint trace removal is not performed) determination. Fingerprint trace removal is, as described above, processing in which an attached fingerprint trace is evaporated by the heat from a fixing device when a paper sheet before being printed with an image (a blank paper sheet) is passed through the fixing device, after which the paper sheet is again returned to the conveyance path and normal image printing is executed. The main body control unit 120 switches between fingerprint trace removal mode and normal mode by comparing the position of each drawing object included in the image data generated by the RIP unit 122 with a fingerprint trace adherence area.

Normal image printing, or normal mode, is processing in which the paper sheet designated by a print job (copy job) is fed, and a drawing object generated based on the print job (copy job) is formed into an electrostatic latent image, which is then transferred and fixed. Needless to say, in normal image printing, or normal mode, fingerprint trace removal, in which an attached fingerprint trace is removed by evaporation by the heat from a fixing device (pair of fixing rollers) when a paper sheet before being printed with an image (a blank paper sheet) is passed through the fixing device, after which the paper sheet is again returned to the conveyance path, is not performed.

Figure 5A:
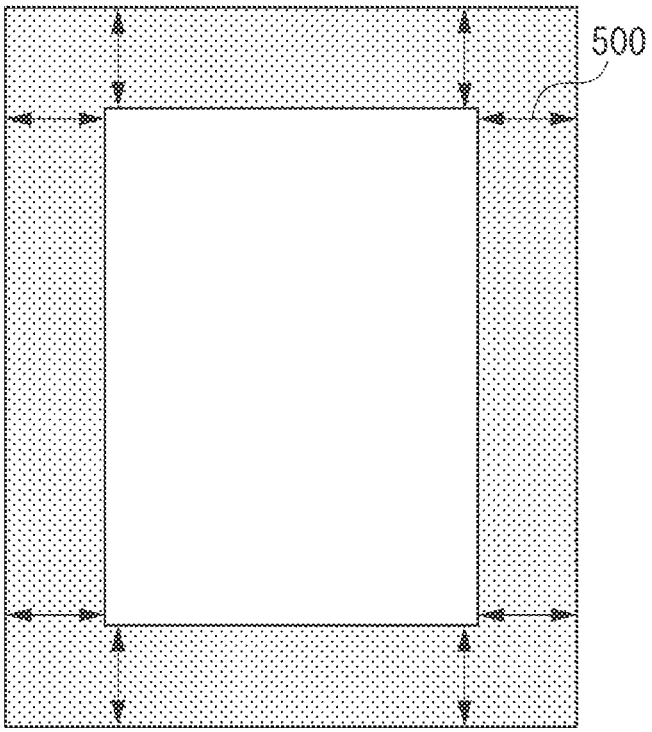
FIG. 5A is a schematic diagram of a fingerprint trace adherence area width.

This operation will now be described in more detail. Fingerprint traces generally adhere to a paper sheet when the user holds the paper. Consequently, fingerprint traces tend to adhere to the paper sheet edges (in the width or length directions) rather than the center of the paper sheet. Therefore, as an area indicating this paper sheet edge on which fingerprint traces tend to adhere, a fingerprint trace area is set as a fingerprint trace adherence area width 500 from each edge of the paper sheet as illustrated in FIG. 5A.

Figure 5B:
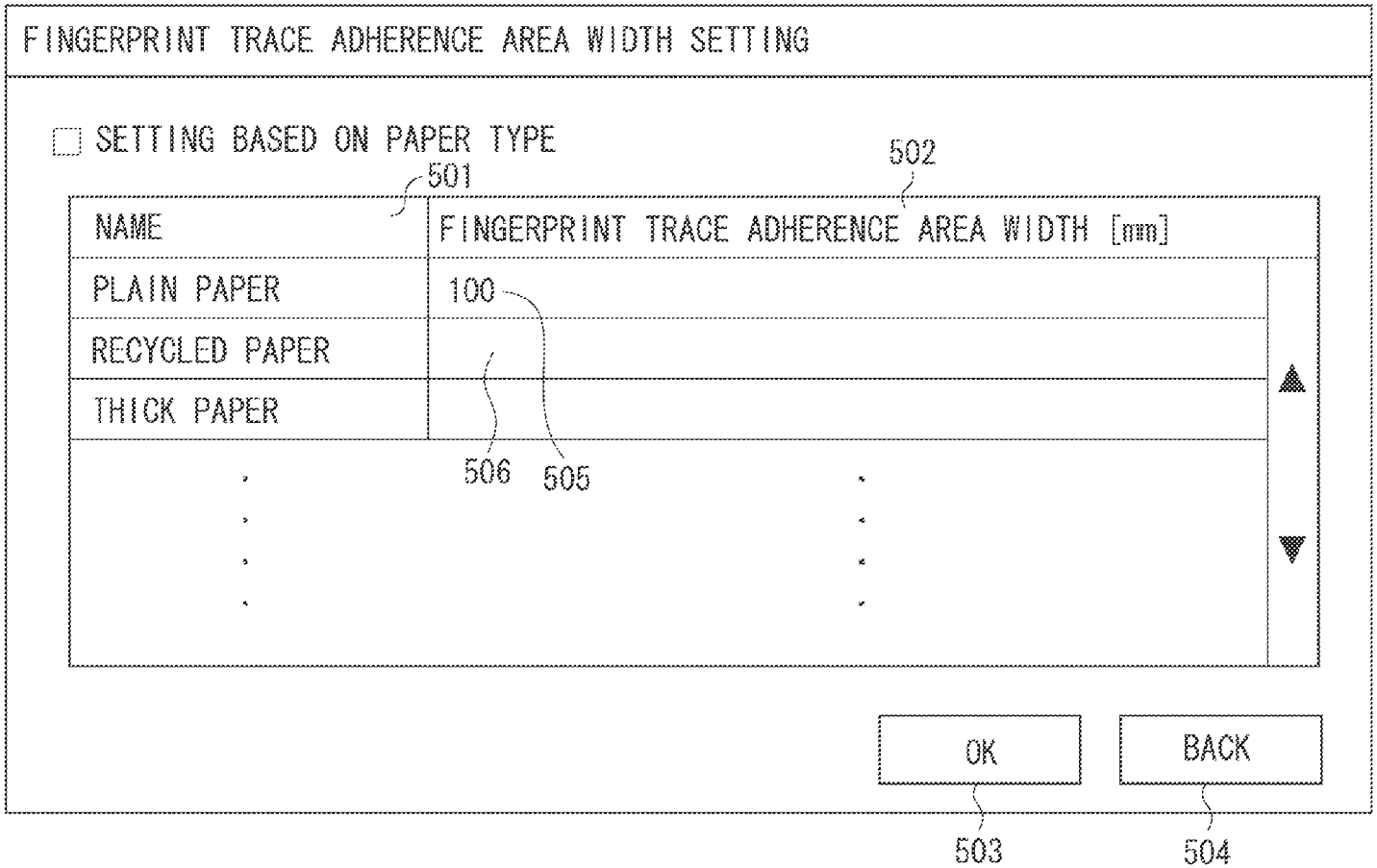
FIG. 5B illustrates a fingerprint trace adherence area setting screen in the main body operation unit.

FIG. 5B illustrates an example of a setting screen for a fingerprint trace adherence area width 500. This setting screen is displayed on the main body operation unit 109 based on a user operation. In the present exemplary embodiment, a fingerprint trace adherence area width 502 is set for each type 501 of paper sheet based on an operation by the user.

When the setting screen is displayed, the main body operation unit 109 acquires the fingerprint trace adherence area width 502 stored by the main body control unit 120. If a fingerprint trace adherence area width 502 has been set by the user, and if a fingerprint trace adherence area width can be acquired for the paper sheet, the main body operation unit 109 displays an acquired value 505, like that for the plain paper setting. If the fingerprint trace adherence area width 502 cannot be acquired for the paper sheet, nothing (indicated by 506 in FIG. 5B) is displayed, like for the recycled paper setting. On the setting screen, changes can be directly made to the fingerprint trace adherence area width 502 based on a user operation. When the OK button 503 is pressed by a user operation on the setting screen, the main body operation unit 109 transmits the fingerprint trace adherence area width 502 for each paper sheet to the main body control unit 120. The main body control unit 120 stores the received fingerprint trace adherence area width 502 for use in the switching determination between fingerprint trace removal mode and normal mode. When the back button 504 is pressed by a user operation on the setting screen, the main body operation unit 109 does not transmit any data to the main body control unit 120.

In the present exemplary embodiment, a paper feed stage setting will be described using an example for when the manual feed tray 410 is replenished with the paper required for printing. The present exemplary embodiment can also be operated with some other paper feed stage.

When the manual feed tray 410 is replenished with paper, the paper feed unit 110 detects the paper, and transmits a paper feed stage setting request to the main body operation unit 109 via the main body control unit 120. When the main body operation unit 109 receives the paper feed stage setting request, it displays the paper size selection screen of the paper feed stage setting illustrated in FIG. 6A.

Figure 6A:
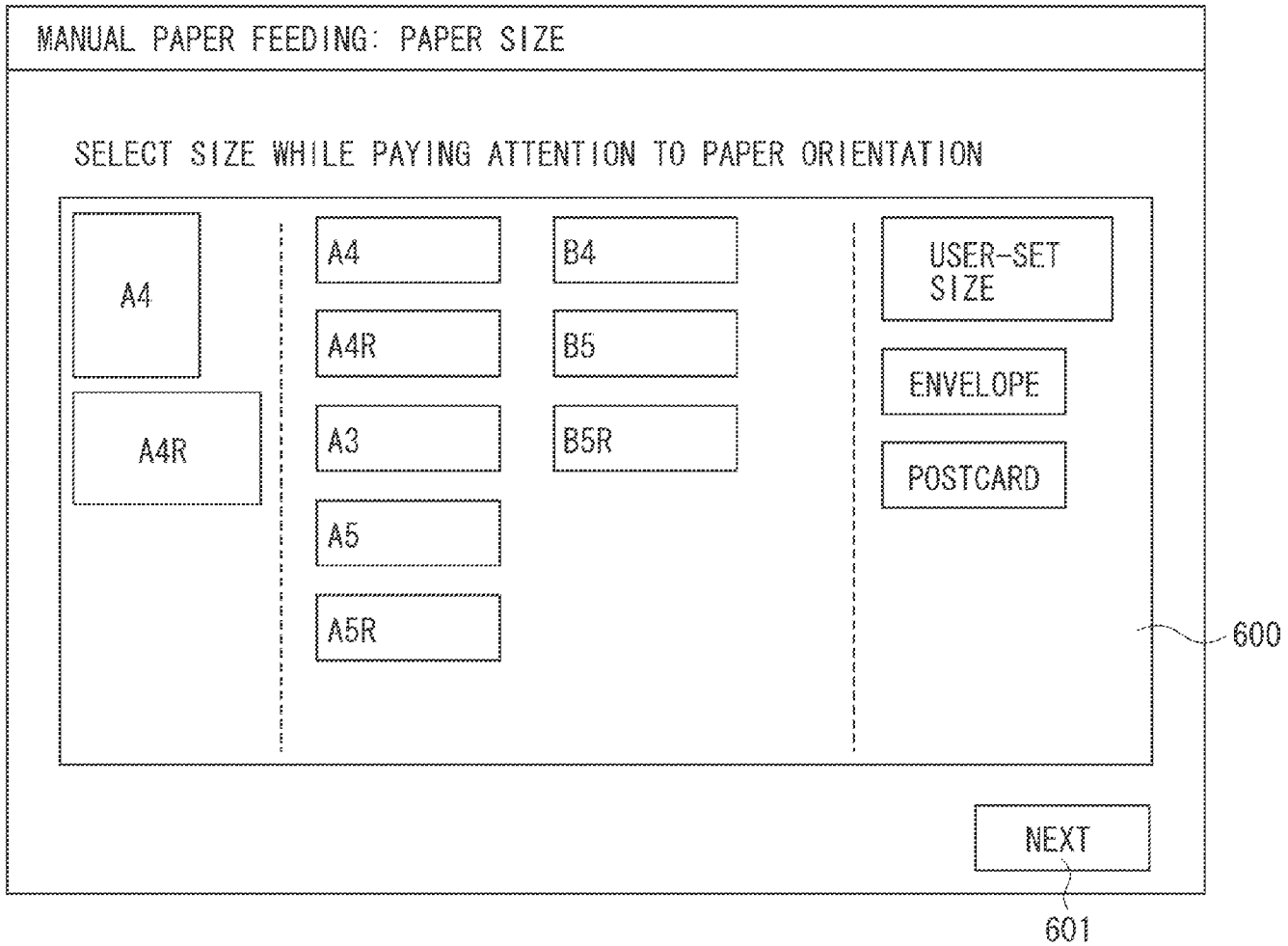
FIG. 6A illustrates a paper size setting screen for manual paper feeding in the main body operation unit.
Figure 6B:
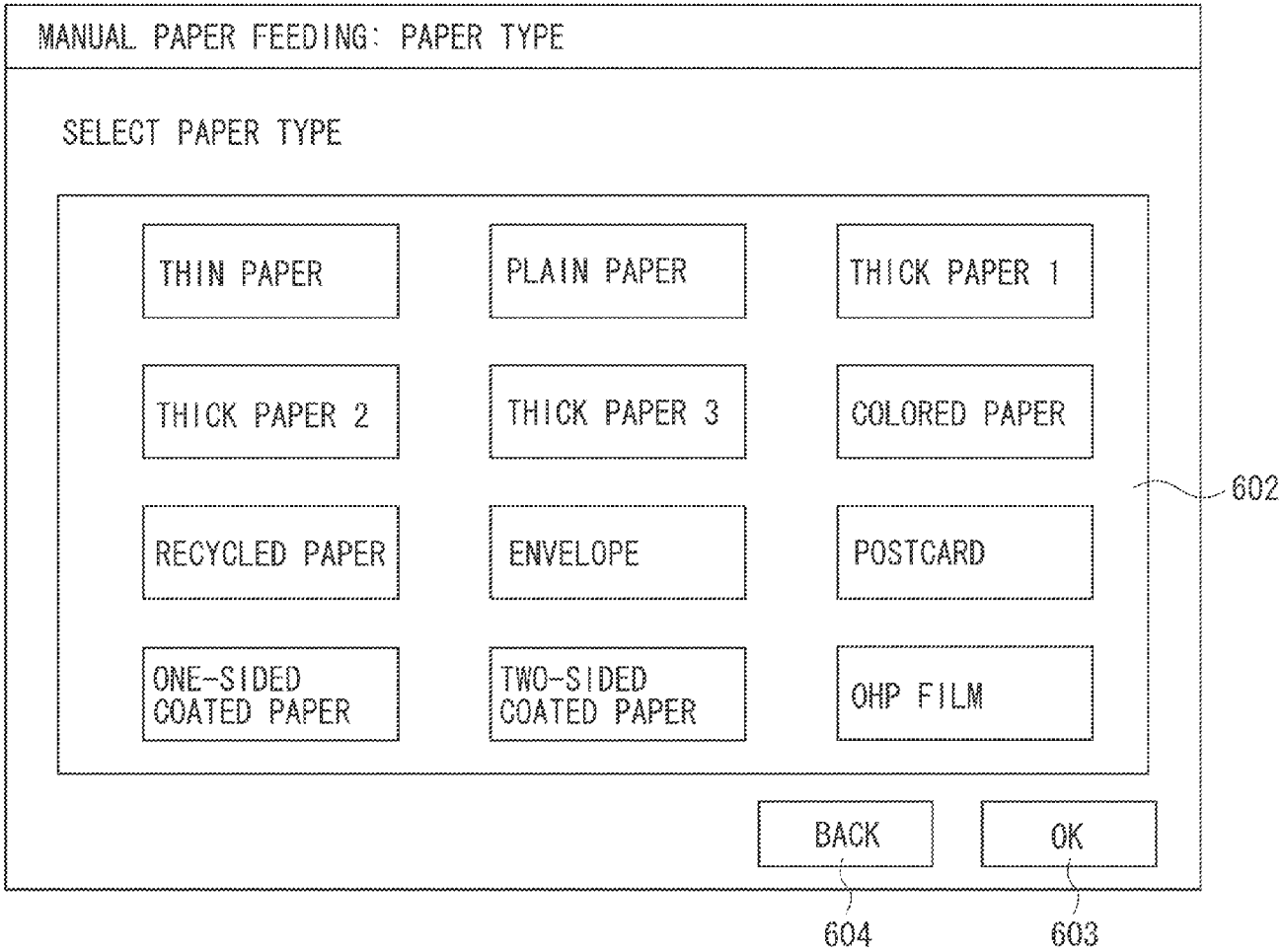
FIG. 6B illustrates a paper type setting screen for manual paper feeding in the main body operation unit.

When the next button 601 is pressed in a state in which the user has selected a paper size 600, the paper size selection screen transitions to the paper type selection screen of the paper feed stage setting illustrated in FIG. 6B. When the OK button 603 is pressed in a state in which the user has selected a paper type 602 on the paper type selection screen, the main body operation unit 109 transmits the selected information about the fed paper to the main body control unit 120. The main body control unit 120 stores the received information about the fed paper for each paper feed stage. When the return button 604 is pressed, the paper type selection screen transitions to the paper size selection screen.

The main body control unit 120 uses the information about the fed paper for the switching determination between fingerprint trace removal mode and normal mode for the print job.

Figure 7:
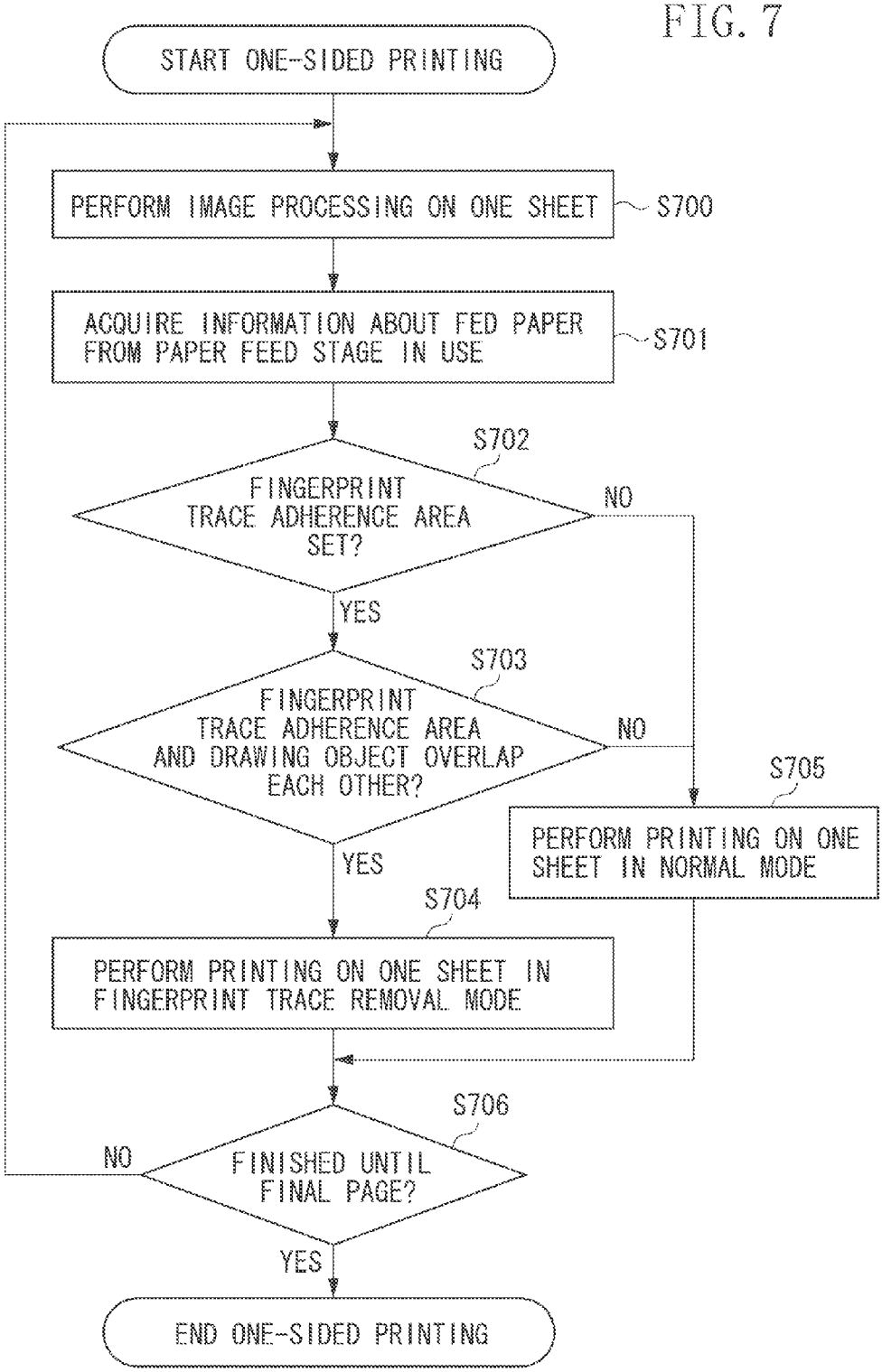
FIG. 7 is a flowchart according to an exemplary embodiment of the present invention.

FIG. 7 is a flowchart illustrating a switch determination operation between fingerprint trace removal mode and normal mode according to the present exemplary embodiment. In step S700, the main body control unit 120 receives image data 126 for one sheet processed by the RIP unit 122 (FIG. 1D). Next, in step S701, the main body control unit 120 acquires the pre-stored fingerprint trace adherence area width 502 using information about the fed paper acquired by the paper feed unit 110. Then, in step S702, the main body control unit 120 determines whether the fingerprint trace adherence area width 502 has been set. If it is determined that the fingerprint trace adherence area width 502 has not been set for the paper sheet to be used in printing (NO in step S702), the processing proceeds to step S705. In step S705, the main body control unit 120 controls the apparatus devices (the paper feed unit 110, the image forming unit 111, and the paper discharge unit 112) so that printing is executed in normal mode. If it is determined that the fingerprint trace adherence area width 502 has been set for the paper sheet used in printing (YES in step S702), the processing proceeds to step S703. In step S703, the main body control unit 120 executes an overlap determination (step S703 will be described in detail with reference to FIGS. 8A to 8D). If it is determined in step S703 that the fingerprint trace adherence area and a drawing object overlap each other (YES in step S703), the processing proceeds to step S704. In step S704, the main body control unit 120 controls the apparatus devices (the paper feed unit 110, the image forming unit 111, and the paper discharge unit 112) so that printing is executed in fingerprint trace removal mode. If it is determined in step S703 that the fingerprint trace adherence area and a drawing object do not overlap each other (NO in step S703), the processing proceeds to step S705, and the main body control unit 120 controls the apparatus devices (the paper feed unit 110, the image forming unit 111, and the paper discharge unit 112) so that printing is executed in normal mode. Finally, in step S706, the main body control unit 120 determines whether the printing processing of the final page has finished. If it is determined that the printing processing of the final page has not finished (NO in step S706), an overlap determination is again performed on each of a plurality of paper sheets on which printing is to be performed by starting the processing for one sheet. If it is determined that the printing processing of the final page has finished (YES instep S706), the entire printing processing is finished.

Figure 8A:
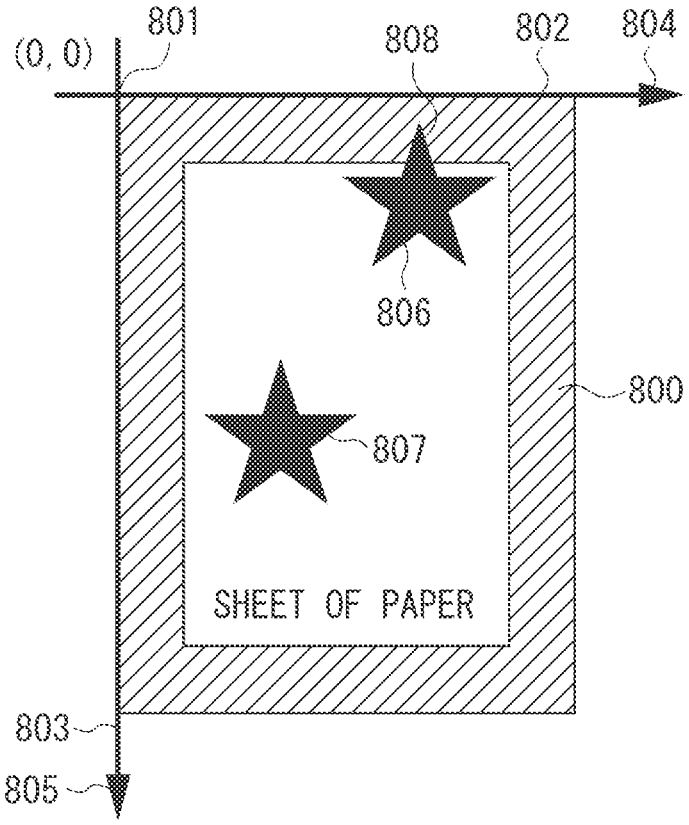
FIG. 8A illustrates an example of a positional relationship between a fingerprint trace adherence area and a drawing object.

FIG. 8A illustrates an example of a relationship between a fingerprint adherence area 800 and a drawing object 806 according to the present exemplary embodiment along with a coordinate system. In FIG. 8A, the top left edge of the paper sheet is set as the coordinate origin 801, the horizontal axis is represented as the X axis 804, and the vertical axis is represented as the Y axis 805. On the X axis 804, the right direction is set as the + direction. On the Y axis 805, the downward direction is set as the + direction. Since the paper sheet in the present exemplary embodiment is described using an example of a vertically long paper sheet (portrait), the paper size height 803>the paper size width 802. If the paper size used in printing changes, the positions of the paper size height 803 and the paper size width 804 also change. The area of the hatched portions at the paper sheet edges indicates the fingerprint adherence area 800. If the main body control unit 120 recognizes that there is even one drawing object 806 overlapping the fingerprint adherence area present, the main body control unit 120 executes printing in fingerprint trace removal mode. If the main body control unit 120 recognizes that all the drawing objects in one paper sheet do not overlap the fingerprint adherence area, like a drawing object 807, the main body control unit 120 executes printing in normal mode.

Figure 8B:
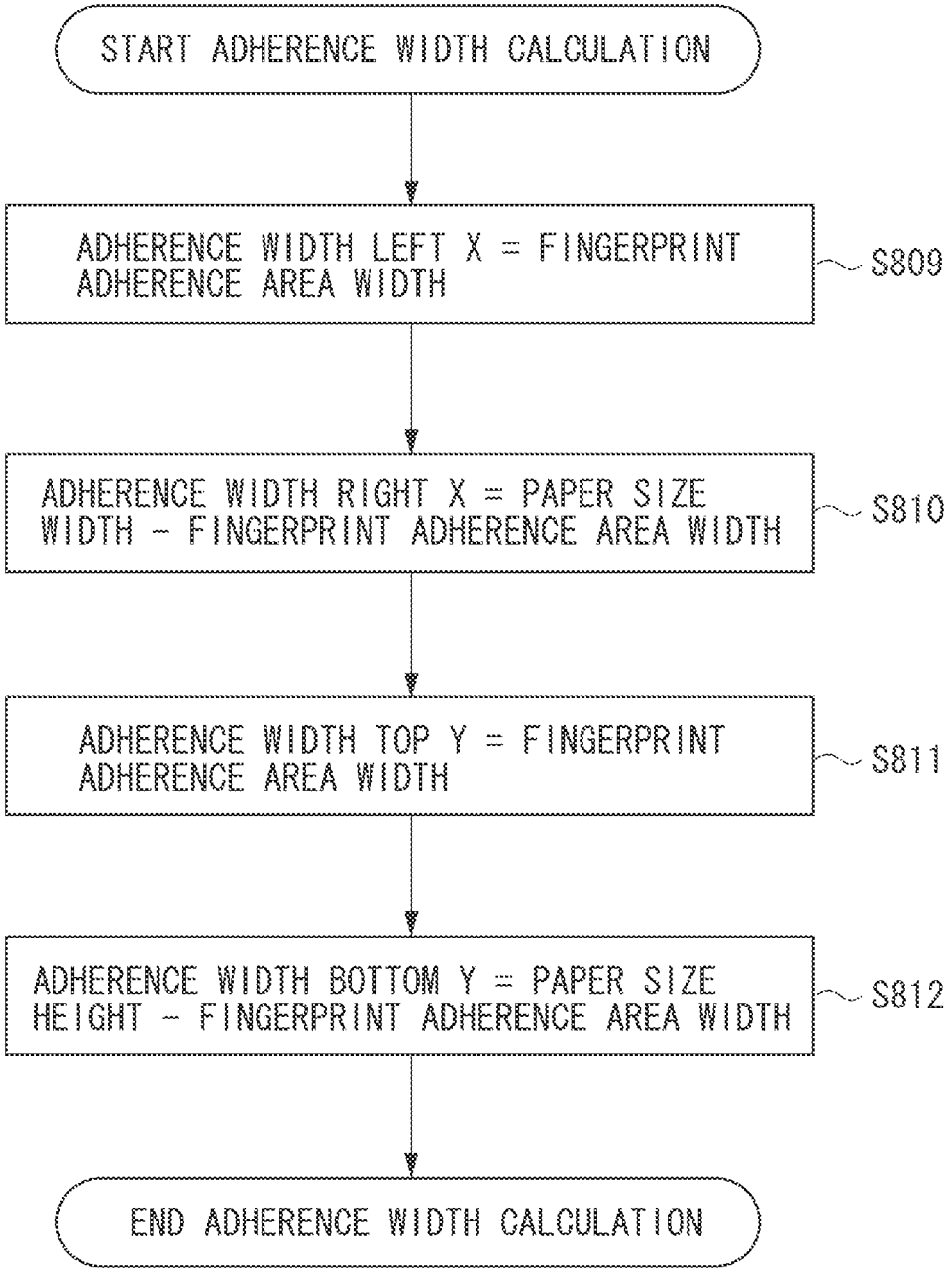
FIG. 8B is a flowchart illustrating adherence width calculation processing performed by a main body control unit.

FIG. 8B is a flowchart illustrating an example of fingerprint trace adherence width calculation processing executed by the main body control unit 120. In step S809, the main body control unit 120 calculates an adherence width left X based on the fingerprint trace adherence area width 502 input from the main body operation unit 109 by the user. In step S810, the main body control unit 120 calculates an adherence width right X by subtracting the fingerprint trace adherence area width 502 from the paper size width 802 received from the paper feed unit 110. In step S811, the main body control unit 120 calculates an adherence width top Y based on the fingerprint trace adherence area width 502. In step S812, the main body control unit 120 calculates an adherence width bottom Y by subtracting the fingerprint trace adherence area width 502 from the paper size height 803 received from the paper feed unit 110.

Figure 8C:
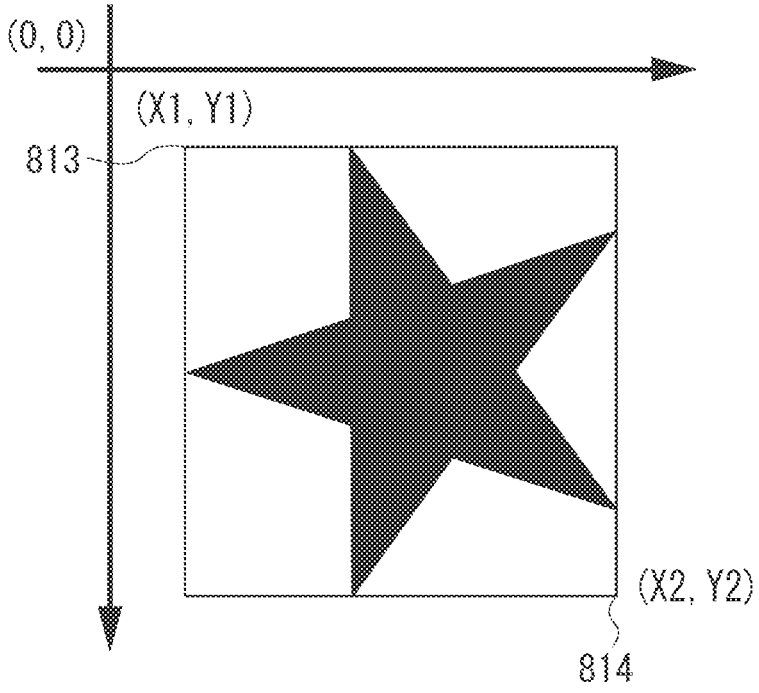
FIG. 8C is a schematic diagram illustrating drawing position calculation of a drawing object.

FIG. 8C is a schematic diagram illustrating drawing position calculation of a drawing object performed by the RIP unit 122. The RIP unit 122 analyzes the shape of a drawing object, and calculates the minimum rectangle 813 that can enclose that shape. If the top left edge of the paper sheet is set as the coordinate origin (0,0), the RIP unit 122 calculates the X coordinate X1 of the corner 814 of that minimum rectangle that is the closest to the origin as a drawing left position X. If the top left edge of the paper sheet is set as the coordinate origin (0,0), the RIP unit 122 calculates the Y coordinate Y1 of the corner 814 of that minimum rectangle that is the closest to the origin as a drawing top position Y. If the top left edge of the paper sheet is set as the coordinate origin (0,0), the RIP unit 122 calculates the X coordinate X2of the corner 815 of that minimum rectangle that is the farthest from the origin as a drawing right position X. If the top left edge of the paper sheet is set as the coordinate origin (0,0), the RIP unit 122 calculates the Y coordinate Y2 of the corner 815 of that minimum rectangle that is the farthest from the origin as a drawing bottom position Y. The RIP unit 122 adds the drawing position calculation results for all the drawing objects on one sheet to the image data and transmits the resultant data to the main body control unit 120.

Figure 8D:
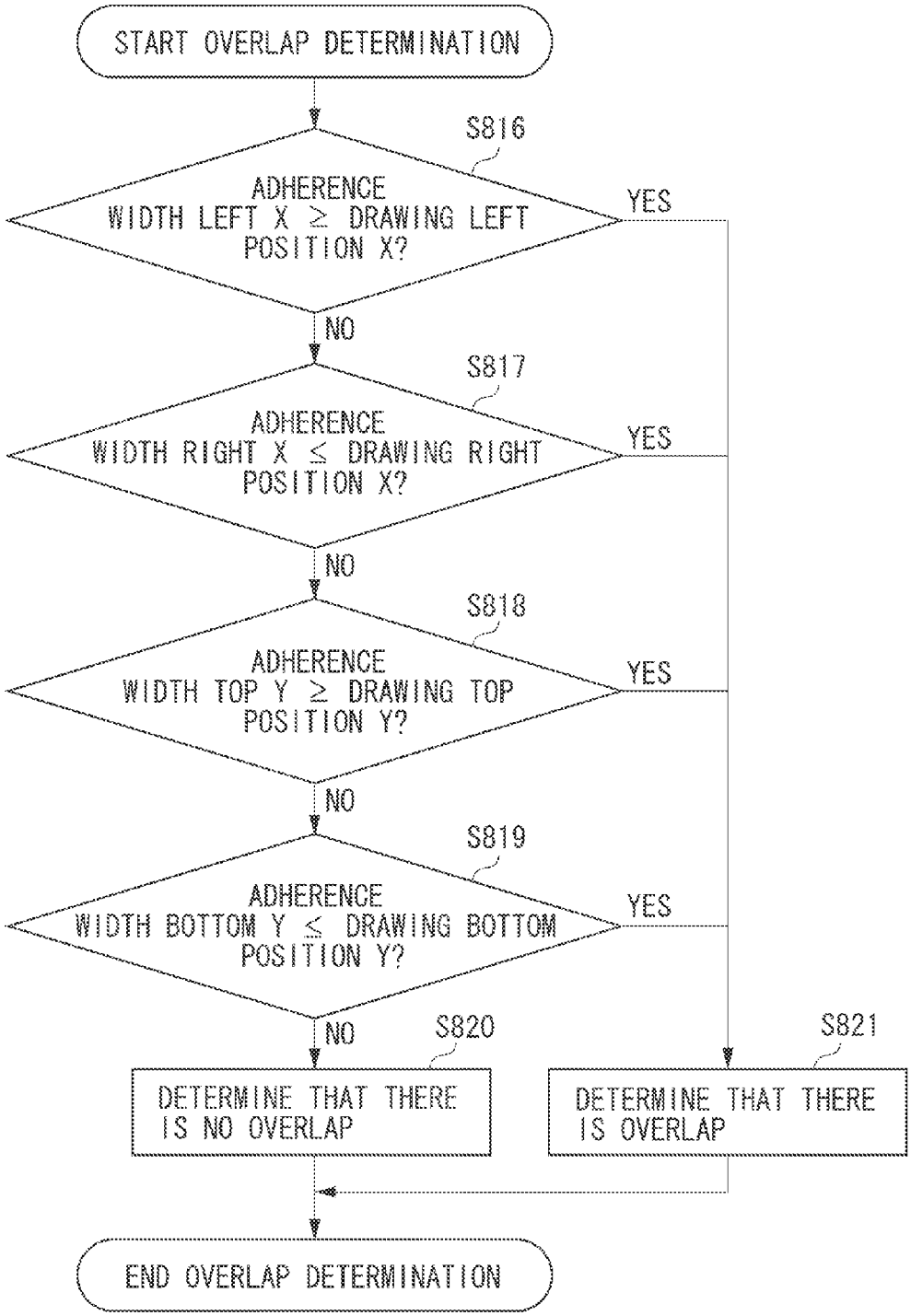
FIG. 8D is a flowchart illustrating overlap determination processing of a fingerprint trace adherence area performed by a main body control unit.

FIG. 8D is a flowchart illustrating an example of overlap determination. The main body control unit 120 executes overlap determination using the above adherence widths and the drawing object drawing position calculation results. In step S816, if the main body control unit 120 determines that the adherence width left X ≥ the drawing left position X (YES in step S816), the processing proceeds to step S821. In step S821, the main body control unit 120 determines that there is an overlap. In step S817, if the main body control unit 120 determines that the adherence width right X ≤ the drawing right position X (YES in step S817), the processing proceeds to step S821. In step S121, the main body control unit 120 determines that there is an overlap. In step S818, if the main body control unit 120 determines that the adherence width top Y ≤ the drawing top position Y (YES in step S818), the processing proceeds to step S821. In step S121, the main body control unit 120 determines that there is an overlap. In step S819, if the main body control unit 120 determines that the adherence width bottom Y ≤ the drawing bottom position Y (YES in step S819), the processing proceeds to step S821. In step S121, the main body control unit 120 determines that there is an overlap. In all other cases (i.e., NO in steps S817, S818, S819, and 819), the processing proceeds to step S820. In step S820, the main body control unit 120 determines that there is no overlap.

In FIG. 7, an example is illustrated in which the switching determination between fingerprint trace removal mode and normal mode is performed on all pages. However, when a paper bundle composed of a plurality of sheets of recording paper is set in the paper feed unit 110, there is a high likelihood that a fingerprint trace is only on the first page and the last page of the bundle. Thus, a configuration can be employed in which a (not illustrated) sensor for detecting when a paper bundle is set after the paper feed unit 110 has run out of paper is provided, and the switching determination between fingerprint trace removal mode and normal mode is performed on either or both of the first and last pages of the paper bundle.

Further, in the present exemplary embodiment, the switching determination can be set based on a user's intentions by providing the main body operation unit 109 with a setting unit that sets so that the switching determination between fingerprint trace removal mode and normal mode is performed on either or both of these first and last pages.

Figure 9A:
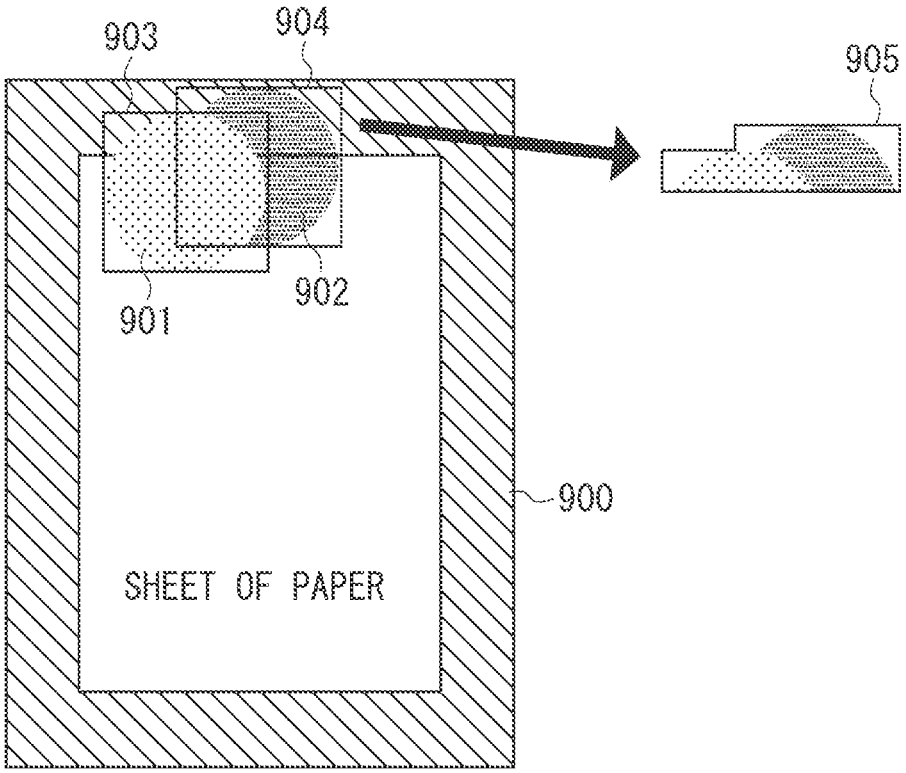
FIG. 9A illustrates an example of drawing color value analysis processing of an overlapping portion.
Figure 9B:
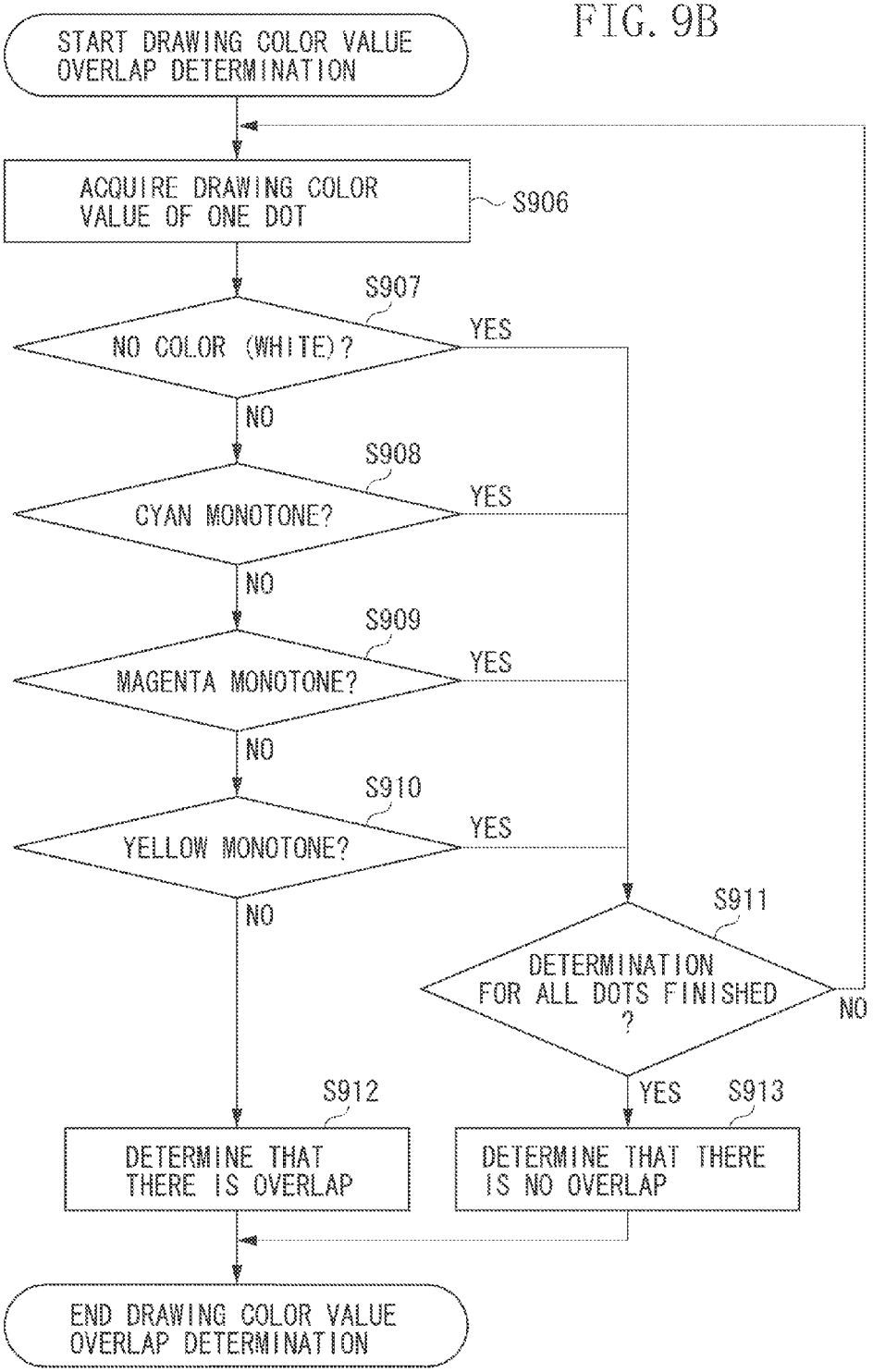
FIG. 9B is a flowchart illustrating drawing color value determination processing performed by a main body control unit.

A second exemplary embodiment will now be described with reference to FIGS. 1 to 8D, 9A, and 9B. FIG. 9A illustrates an example of drawing color value analysis processing of an overlapping portion. FIG. 9B is a flowchart illustrating overlap determination performed based on a drawing color value of a drawing object. Since the description of FIGS. 1 to 8D is the same as in the first exemplary embodiment, the description of the second exemplary embodiment will omit that portion and focus on only the portions in which processing is different.

The RIP unit 122 generates drawing data by calculating a drawing color value for each dot using a drawing color value included in the drawing object. In the present exemplary embodiment, this drawing color value is a color density in cyan, magenta, yellow, and black expressed as a numerical value. However, operation based on the present exemplary embodiment is possible even if, for example, the drawing color value is expressed in red, green, and blue, as long as the drawing data has a drawing color value.

In the processing illustrated in the flowchart of FIG. 8D, if it is determined in step S821 that there is an overlap (YES in step S821), the main body control unit 120 executes the drawing color value analysis of an overlapping portion illustrated in FIG. 9A, and executes the overlap determination based on a drawing color value illustrated FIG. 9B.

FIG. 9A illustrates two drawing objects 901 (1) and 902 (2) that are both overlapping a fingerprint trace adherence area 900. The main body control unit 120 extracts a minimum rectangle (1) 903 and a minimum rectangle (2) 904 of the drawing objects 901 (1) and 902 (2), respectively, and the fingerprint trace adherence area 900, and generates a composite drawing object 905.

The main body control unit 120 executes overlap determination based on the drawing color value illustrated in FIG. 9B for the drawing color value of each dot in the composite drawing object 905. If the drawing objects do not overlap, the main body control unit 120 executes overlap determination based on the drawing color value for each dot in each drawing object. In step S906, the main body control unit 120 acquires a drawing color value from one dot in the composite drawing object 905. In step S907, the main body control unit 120 determines whether the drawing color value indicates no color (i.e., white). If it is determined that the drawing color value indicates no color (YES in step S907), the main body control unit 120 determines that, since a fingerprint trace does not stand out, there is no overlap, and the processing proceeds to step S911. In step S908, the main body control unit 120 determines whether the drawing color value indicates a cyan monotone. If it is determined that the drawing color value indicates a cyan monotone (YES in step S908), the main body control unit 120 determines that, since a fingerprint trace does not stand out, there is no overlap, and the processing proceeds to step S911. Instep S909, the main body control unit 120 determines whether the drawing color value indicates a magenta monotone. If it is determined that the drawing color value indicates a magenta monotone (YES in step S909), the main body control unit 120 determines that, since a fingerprint trace does not stand out, there is no overlap, and the processing proceeds to step S911. In step S910, the main body control unit 120 determines whether the drawing color value indicates a yellow monotone. If it is determined that the drawing color value indicates a yellow monotone (YES in step S910), the main body control unit 120 determines that, since a fingerprint trace does not stand out, there is no overlap, and the processing proceeds to step S911. In step S911, the main body control unit 120 confirms whether determination has been performed on all dots. If it is determined that the determination for all dots has not finished (NO in step S911), the processing returns to step S906, and the main body control unit 120 performs a determination on the next dot. If it is determined that the determination for all dots has finished (YES in step S911), the processing proceeds to step S913. In step S913, the main body control unit 120 determines that there is no overlap. If it is determined that even one dot has a drawing color value indicating any one of the colors, and that that color is not cyan monochrome, magenta monochrome, or yellow monochrome (NO in steps S907 to S910), in step S912, the main body control unit 120 determines that there is an overlap.

Based on the above configuration, even if a fingerprint trace is on the paper sheet, if a drawing object overlapping the fingerprint trace is a cyan monochrome, a magenta monochrome, or a yellow monochrome, since the fingerprint trace does not stand out, processing is performed in normal mode.

Consequently, the processing time can be reduced, because fingerprint trace removal mode is executed only when a fingerprint trace stands out, even if a drawing object overlaps the fingerprint trace.

Further, fingerprint traces standout in a dense grey portion in which cyan, magenta, and yellow overlap. Accordingly, a configuration can be employed in which an upper and lower threshold are predefined in order to determine that the cyan, magenta, and yellow drawing color values are at an intermediate level, and if any of the cyan, magenta, or yellow drawing color values of a drawing object found to be overlapping in the overlap determination are between the upper and lower thresholds, processing is executed in fingerprint trace removal mode.

If there is an overlap, the main body control unit 120 executes fingerprint trace removal mode based on the overlap determination result performed based on the drawing color values, and if there is no overlap, the main body control unit 120 executes the print job by controlling the apparatus devices in normal mode.

In the first exemplary embodiment, a fingerprint trace adherence area width 502 is set for each type of paper sheet. However, for some types of paper sheet, such as recycled paper, fingerprint traces do not stand out as much. Therefore, the system may be configured so that, based on the type of paper, processing is always performed on paper sheets on which fingerprint traces do not stand out in normal mode without setting a fingerprint trace adherence area width 502.

Further, the apparatus administrator or the user performing printing can switch between setting the fingerprint trace adherence area width 502 ON and OFF by selecting, on the main body operation unit 109 of the image forming unit 111, the types of paper for which the fingerprint trace adherence area width 502 should be set. When the fingerprint trace adherence area width 502 is set to OFF, the fingerprint adherence area width in FIG. 5B cannot be set for paper types set to "OFF".

According to the first and second exemplary embodiments, by comparing the position where toner is to be attached and a fingerprint trace adherence area for each paper sheet used in printing, and confirming the color of the toner to be used in printing, paper sheets that do not need to be printed in fingerprint trace removal mode are printed in normal mode. Consequently, needless delays in the printing time can be avoided.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s), For this purpose, the program is provided to the computer for example via a network or from a recording medium of various types serving as the memory device (e.g., computer-readable medium), While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-261838 filed Nov. 30, 2011, which is hereby incorporated by reference herein in its entirety.

What is claimed is:

1. An image forming apparatus comprising:

a feeding unit configured to feed a paper sheet;

a fixing unit configured to fix a toner image onto the paper sheet fed by the feeding unit based on an image to be printed; and a determination unit configured to determine, for each page, whether to execute, by the fixing unit, fingerprint trace removal processing for removing a fingerprint trace adhering to the paper sheet fed by the feeding unit, wherein if it is determined to execute the fingerprint trace removal processing, the fixing unit is configured to perform the fixing of the toner image after performing the fingerprint trace removal processing.

2. The image forming apparatus according to claim 1, further comprising an overlap determination unit configured to determine an overlap between the toner image and a fingerprint trace adherence area based on the paper sheet fed by the feeding unit, wherein if it is determined by the overlap determination unit that the toner image and the fingerprint trace adherence area overlap, the determination unit is configured to determine to execute the fingerprint trace removal processing.

3. The image forming apparatus according to claim 2, further comprising a color value determination unit configured to determine a density of the image to be printed, wherein, if it is determined by the overlap determination unit that the toner image and the fingerprint trace adherence area overlap, and if it is determined by the color determination unit that image to be printed is a predetermined density or more, the determination unit is configured to determine to execute the fingerprint trace removal processing.

4. An image forming apparatus comprising:

a feeding unit configured to feed a paper sheet;

a fixing unit configured to fix a toner image onto the paper sheet fed by the feeding unit based on an image to be printed; and a determination unit configured to determine whether to execute, by the fixing unit, fingerprint trace removal processing for removing a fingerprint trace adhering to the paper sheet fed by the feeding unit only if the paper sheet is a specific type, wherein if it is determined to execute the fingerprint trace removal processing, the fixing unit is configured to perform the fixing of the toner image after performing the fingerprint trace removal processing.

5. An image forming method comprising:

feeding a paper sheet;

fixing a toner image onto the fed paper sheet based on an image to be printed;

determining, for each page, whether to execute, by fixing, fingerprint trace removal processing for removing a fingerprint trace adhering to the fed paper sheet, and if it is determined to execute fingerprint trace removal processing, performing the fixing of the toner image after performing the fingerprint trace removal processing.

* * * * *